United States Patent [19]

Moore

[11] 4,057,211

[45] Nov. 8, 1977

[54] SAFETY SYSTEM FOR OVERHEAD SUPPORT OF WEIGHTED ARTICLES

[75] Inventor: Junius Thomas Moore, Charleston, W. Va.

[73] Assignee: The Moore Company, Inc., Charleston, W. Va.

[21] Appl. No.: 658,051

[22] Filed: Feb. 13, 1976

[51] Int. Cl.[2] ..... B42F 13/00

[52] U.S. Cl. ..... 248/332; 248/320; 254/156

[58] Field of Search ..... 24/115 E, 116 R, 116 A; 188/64, 65.1, 65.2; 211/113, 116, 117; 248/320, 321, 322, 332; 254/155, 156, 192, 193, 197

[56] References Cited

U.S. PATENT DOCUMENTS

| | | | |
|---|---|---|---|
| 318,314 | 5/1885 | Skinner | 24/116 R |
| 491,541 | 2/1893 | Fletcher | 248/321 |
| 590,759 | 9/1897 | Hartshorn | 254/191 |
| 1,042,150 | 10/1912 | Scheible | 248/320 |
| 1,449,363 | 3/1923 | Lee | 254/191 |
| 1,595,891 | 8/1926 | Taylor | 24/116 R |
| 2,907,549 | 10/1959 | Walker | 254/191 X |
| 2,923,515 | 2/1960 | Farrington et al. | 248/321 |
| 2,962,253 | 11/1960 | Moore | 248/320 |
| 3,313,526 | 4/1967 | Owens | 254/191 |

FOREIGN PATENT DOCUMENTS

| | | | |
|---|---|---|---|
| 716,709 | 12/1931 | France | 254/191 |
| 314,927 | 10/1919 | Germany | 24/115E |
| 476,570 | 5/1929 | Germany | 254/191 |
| 272,370 | 3/1951 | Switzerland | 188/65.1 |

*Primary Examiner*—Lawrence J. Staab

*Attorney, Agent, or Firm*—Cushman, Darby & Cushman

[57] ABSTRACT

An improved safety system or apparatus for raising, lowering, and supporting in an elevated or lowered position a weighted article from an overhead support. The system or apparatus includes a safety pulley member having a pulley sheave over which a link chain passes, the link chain having one end connected to the weighted article and the other end connected to an attachment means positioned within reach of a person so that the person may pull the link chain downwardly to raise the weighted article to a desired elevation out of reach, the link chain then being locked to the attachment means. The weighted article may be a clothes basket, other receptacle, or any other article in which it is desired to suspend overhead. When tension in the link chain between the safety pulley member and the fixed attachment means is suddenly or abruptly reduced and the weighted article begins to fall by gravity and the safety pulley member swivels by gravity to a position where its arrestor arm interrupts the path of the link chain and grips a single link of the chain and prevents the weighted article from dropping freely to the floor.

14 Claims, 15 Drawing Figures

Fig. 5.
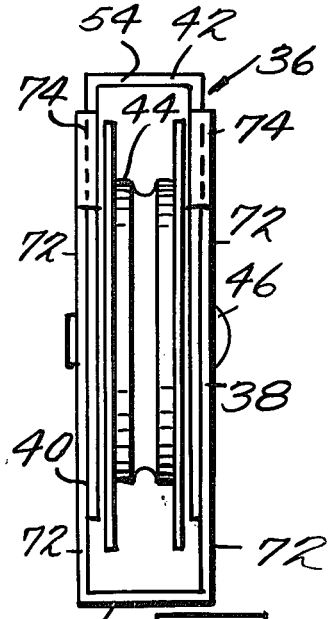
Fig. 4.
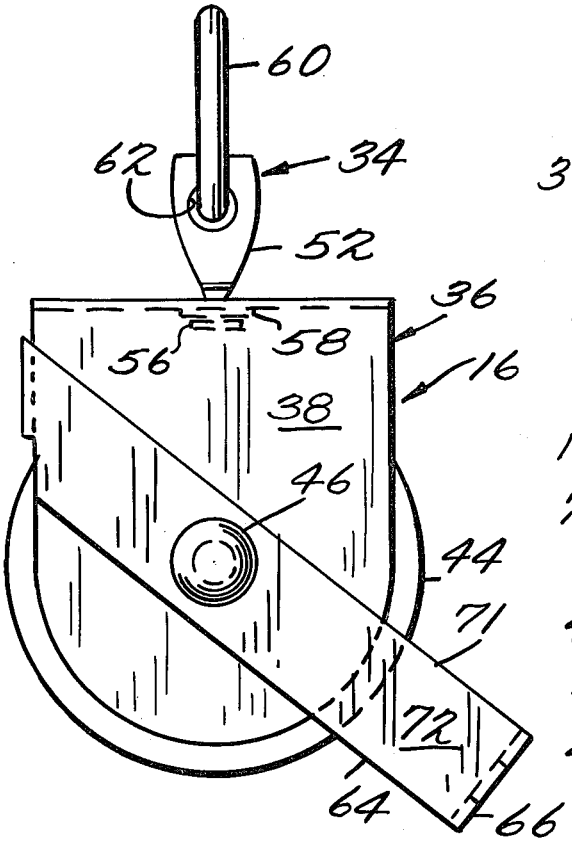
Fig. 6.
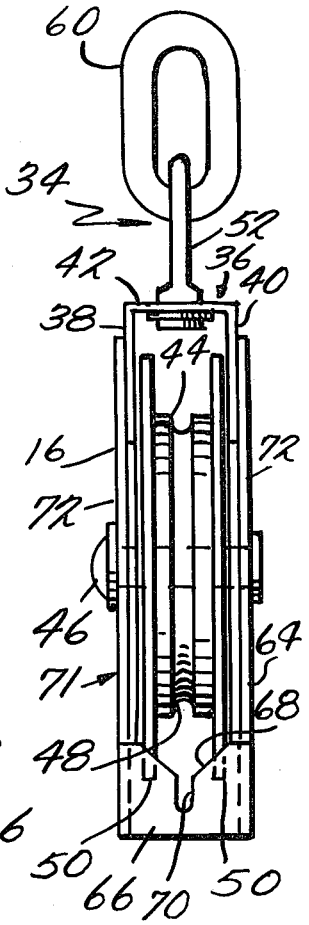
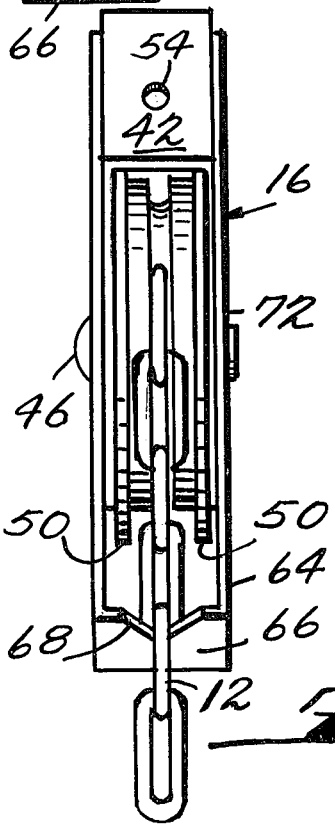
Fig. 9.
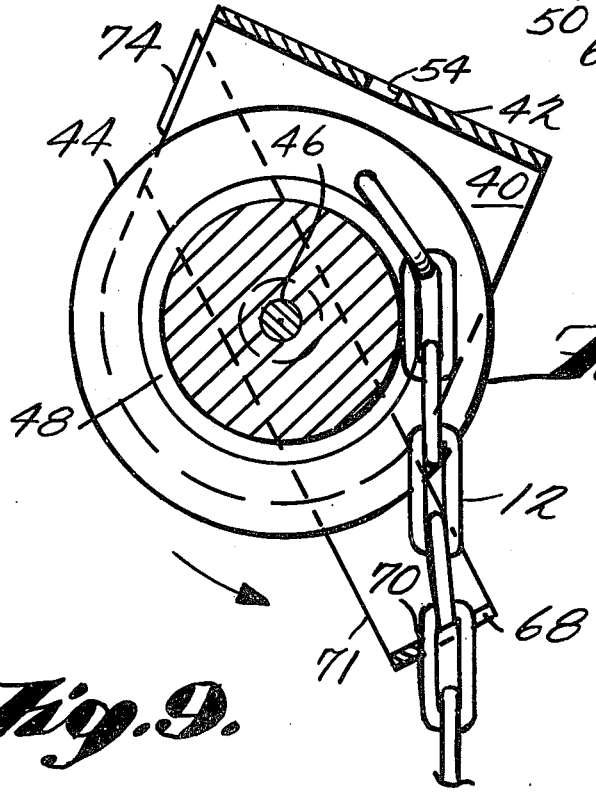
Fig. 8.

SAFETY SYSTEM FOR OVERHEAD SUPPORT OF WEIGHTED ARTICLES

The present invention relates to an improved safety system or apparatus for suspending a weighted article from an overhead support means, the system or apparatus being also capable of lowering or raising the article when desired. Additionally, the present invention relates to an improved safety pulley member for use in systems or apparatus to raise, lower and suspend a weighted article by a link chain.

BACKGROUND OF THE INVENTION

In the prior U.S. Pat. No. 2,962,253 issued Nov. 29, 1960 to Junius T. Moore, Jr. and having a common assignee to this application, namely, The Moore Company of Charleston, West Virginia, there is disclosed a system or apparatus for storing clothing and/or other articles by utilizing a receptacle such as shown in U.S. Pat. No. 2,620,074, issued Dec. 2, 1952 to Junius T. Moore, Jr. and also assigned to the common assignee. The receptacle is supported on the end of a link chain which passes over a pulley arrangement fixed to an overhead support member and then passes downwardly, the link chain, having its other end attached to a fixed attachment means within reach of a person. In this system when the link chain is fully extended it has a length sufficient to support the receptacle within reach of a person, but the link chain can be grasped above the attachment means and pulled downwardly to elevate the receptacle, the chain having means thereon for detachably locking the same to the attachment means so as to support the receptacle in an elevated position out of reach of the person. This type of system or apparatus has found widespread use in locker rooms of industrial and manufacturing plants for hanging clothes and storing articles such as shoes, helmets or the like where it is desirable to provide a clean and airy locker room with a maximum floor space. While the system disclosed in U.S. Pat. No. 2,962,253 has found widespread use throughout industrial and manufacturing plants, it is not entirely satisfactory at this time because of the increasing demands for safety in all phases of operation.

Municipal, state and federal governments have in recent years been investigating safety standards in all phases of operation in equipment of manufacturing plants, industrial plants, mines and the like and they have been enacting laws to upgrade the working standards so as to protect the individual. A system or apparatus such as described in the aforementioned U.S. Pat. No. 2,962,253 would not be substantially foolproof in its operation to meet rigid safety standards if such are applied by government agencies or the plants themselves. If a person, when operating the system or apparatus of the aforementioned patent to raise or lower the weighted article, was to accidentally lose grasp of the link chain, the sudden relaxing of tension in the link chain would cause the article to fall rapidly by gravity and since the weighted article would fall to a lowered position in reach of a person, it could cause injury to a person who happened to be beneath the article. Also, the abrupt stopping of the article could cause damage to elements of the system. If the link chain was to fail between the pulley means and the fixed attachment means so that tension was released fully and abruptly in the chain, the article or receptacle would fall rapidly by gravity to the floor and would present a hazardous condition of possible injury to a person standing beneath the suspended article.

PRIOR ART

Prior art on this subject is represented by the following patents which disclose pulley members and/or systems having spring loaded or movable pawls or dogs for arresting cables or chains:

| NUMBER | NAME | DATE |
|---|---|---|
| 271,252 | MASCHMEYER | Jan. 30, 1883 |
| 465,665 | HOWARD, JR. | Dec. 22, 1891 |
| 524,015 | YOUNG | Aug. 7, 1894 |
| 585,145 | WILSON | June 22, 1897 |
| 590,759 | HARTSHORN | Sept. 28, 1897 |
| 2,187,361 | PALSSON | Jan. 16, 1940 |

In the disclosures of the above-listed prior art, the operation of the systems or apparatus is such that the chain or cable is arrested by a pawl which may be spring loaded and/or movable relative to the member, the arresting action being actuated by a change in the angle of pull on the free end of the chain or cable. In some instances the easing of tension on the chain or rope allows the spring actuated pawl to engage whereas in other instances the reduction of speed of the cable actuates the movable pawl element. None of these patents disclose a pulley member wherein the arrestor arm is fixed relative to the housing of the pulley member and the swivel movement of the pulley member by a release of tension in the cable causes the arrestor arm to move into the path of the link chain to engage one of the links and prevent further movement of the chain and the weighted article.

BRIEF SUMMARY OF THE INVENTION

In its basic form, the present invention relates to an improvement in a system or apparatus for raising and lowering a weighted article between supported elevated and supported lower positions and it comprises an overhead support means with a pair of pulley members supported therefrom at laterally spaced points from each other, at least one of the pulley members including swivel means for supporting it from the overhead support means. A fixed attachment means is provided within reach of a person and a link chain connected at one end to the weighted article passes vertically upwardly over the swivel supported pulley member then over the other pulley member and vertically downwardly and is connected at its other end to the attachment means, the chain having a length when fully extended sufficient to permit the weighted article to be in reach of a person. The chain is provided with means at a sufficient distance from its end connected to the attachment means for connecting the chain to the attachment means when the chain is drawn downwardly to raise the weighted article to the supported elevated position. The pulley member because it can swivel relative to the support means does swivel at an angle to the vertical through its point of support during normal operation of raising, lowering and supporting the article in elevated and lower positions and the pullely member has a housing with a rotatable pulley sheave supported therein and a chain arrestor arm projecting therefrom and having at least a portion extending transverse of and radially spaced outwardly from the pulley sheave and out of the path of the chain during normal operation. The arrestor arm is provided on it portion extending transverse of and spaced from the pulley with stop means which engage and stop the chain when tension in the chain between the swivel supported pulley member and the fixed attachment means is abruptly reduced and the pulley member swings or swivels toward the verticl to move the arrestor arm and its stop means to engagement with the chain.

In a specific embodiment of the invention, there is provided an improved safety pulley member for attachment to an overhead support means and used in systems to raise and lower and suspend a weighted article by a link chain, the pulley member comprising a U-shaped housing having a pair of spaced legs connected by a cross pieve, a pulley sheave rotatably mounted between the legs and swivel means carried by the cross piece for attachment to the overhead support means. The swivel means permit the pulley member to swivel at an angle to the vertical when the link chain with tension therein passes over the pulley sheave and the housing is provided with an arrestor arm projecting therefrom downwardly and outwardly and having at least a portion extending transverse of and spaced from the pulley sheave, the arrestor arm having stop means on its portion for engaging and stopping the link chain when tension in the chain is reduced to permit the pulley member to swivel toward a vertical position.

A further feature of the present invention is to provide the stop means with a V-shaped guide terminating in a rectangular slot, the V-shaped guide directing one link of the chain into the rectangular slot for resisting passage of further links.

A further feature of the present invention is to support the pulley members at spaced points which are horizontally spaced from each other or horizontally and vertically spaced with respect to each other. When the pulley members are horizontally and vertically spaced with respect to each other and a line through the pulley members is in the order of fifteen degrees or greater, the safety pulley member with the arrestor bar is supported at the lower elevation.

These and other features and advantages of the present invention will become apparent in the more detailed discussion which follows and in that discussion reference will be made to the accompanying drawings as briefly described below.

BRIEF DESCRIPTION OF THE DRAWINGS

FIG. 4 is an enlarged side elevational view of the improved safety pulley member of the present invention.

FIG. 5 is an end elevational view of the pulley member of FIG. 4 looking from the left to the right of FIG. 4 and with the swivel means being omitted.

FIG.6 is an end elevational view of the safety pulley member of FIG. 4 but looking from the right to the left of FIG. 4.

FIG. 8 is a vertical view of the pulley member of FIG. 4 but showing the pulley member in a position where it is arresting the link chain.

FIG. 9 is an end elevational view of the pulley member of FIG. 8 looking from the right to the left of FIG. 8.

DETAILED DESCRIPTION OF THE INVENTION

Figure 1:
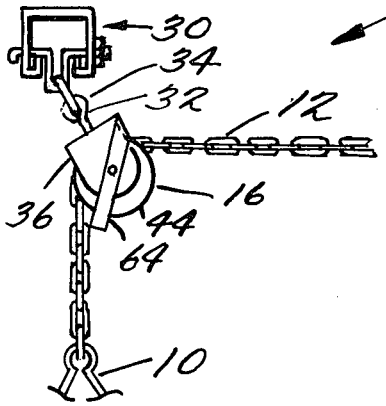
FIG. 1 is a schematic view of the improved safety system or apparatus of the present invention installed in a locker room with the weighted article in the lowered supported position.
Figure 1:
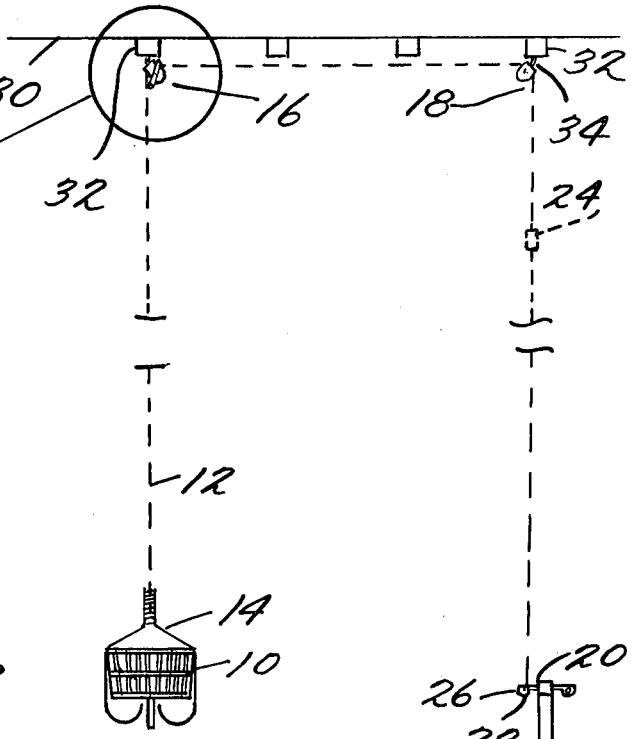

Referring now to the drawings wherein like characters or reference numerals represent like or similar parts, the safety system or apparatus of the present invention is best shown in FIG. 1 and includes a weighted article 10 which may be a receptacle or basket of the type disclosed in the aforementioned U.S. Pat. No. 2,620,074, a link chain 12 secured at one end to the bail-like handle 14 of the article 10, the link chain 12 extending vertically upwardly over a safety pulley member 16 and then laterally and over a second pulley member 18 and then downwardly and connected at its other end to a fixed attachment means 20 supported within reach of a person. The fixed attachment means 20 may be a horizontal rail or like such as disclosed in U.S. Pat. No. 3,673,719 and suitably supported on a bench structure or wall 22. In the position shown in FIG. 1, the article 10 is supported at a lowered position withing reach of a person utilizing the same and it will be evident that the link chain 12 has a length, in its fully extended position, from its point of connection to the article 10 to its point of permanent connection to the attachment means 20. The link chain is provided with a C-hook or locking link 24 which has an aperture large enough to slip over an enlarge loop head 26 of a locking bolt means 28 extending from the attachment means or rail 20. By drawing the link chain 12 downwardly and then placing the link 24 on the bolt 28, the weighted article 10 will be raised vertically upwardly in the locker room and supported at an elevated position. A lock not shown may then be attached to the loop head 26 to secure the article 10 in the elevated position.

Each of the pulley member 16 and 18 are illustrated as being swivel supported from the overhead support means 30 which in this case may be frame structure of the ceiling of the locker room and elongated channel shaped frame members 32 of the type disclosed in the aforementioned U.S. Pat. No. 3,698,676. As shown in FIG. 1 and more clearly by reference to FIGS. 2 and 3 swivel means 34 on each of the pulley members 16 and 18 cause the pulley members 16 and 18 to assume a position at an angle to a vertical to their point of attachment to the overhead support means 30 when tension is provided in the link chain 12 during normal operation. In this respect, the link chain 12 applies a load on each of the pulleys 16 and 18 during normal operation when the weighted article 10 is either supported in the lowered position (FIG 1) or the upper position (not shown) and when the weighted article is being raised or lowered by a person manipulating the link chain 12 at the attachment means 20. While it is not necessary to provide swivel means for the pulley member 18, it is necessary that such swivel means be provided for the safety pulley member 16 since movement of this pulley member causes the pulley member to function as an arrestor during emergency situations. A more detailed description of this operation will follow later in the specification but at this time it is felt best to describe in detail the structure of the safety pulley member 16.

Referring now in detail to FIGS. 4-9 inclusive the safety pulley member 16 includes a U-shaped housing 36 having spaced legs 38 and 40 connected by a cross piece 42. The housing 36 rotatably supports a pulley sheave 44 by means of a pin 46 extending through suitable apertures in the legs 38 and 40 of the housing 36. The pulley sheave 44 which is made of DELRIN or other high tensile strength, tough, fatigue enduring and self-lubricating plastic has a slot groove configuration 48 between its flanges 50 to properly guide the link chain passing across the pulley sheave 44. The swivel means 34 for the pulley member 16 is in effect a double swivel as it includes a swivel connector 52 extending through an aperture 54 in the cross piece 42 and having a head 56 thereon separated from the crops piece by a nylon bushing 58 and a link 60 passing through a aperture 62 in the swivel connector 52. As will now be evident the swivel connector 52 can rotate 360° on its axis through the aperture 54 whereas it can also swivel relative to the link 60 and thus in effect the swivel means provides a somewhat universal type connection for the pulley member 16 with the overhead support means 30. As mentioned above it is not absolutely necessary to provide a swivel means 34 for the pulley member 18 but in situations where such a swivel means is provided, it may be identical to that described for the pulley member 16. Additionally, the construction of the pulley member 18 may also be identical to that thus far described for the pulley member 16.

The safety pulley member 16 is provided with an arrestor arm 64 having at least a portion 66 which extends transversely of and spaced radially outwardly of the pulley sheave 44. The portion 66 provides a stop means for the link chain 12 when the load or tension is released and this stop means includes a V-shaped guide 68 terminating in a rectangular slot 70 having a width sufficient to receive a single link of the chain as shown in FIG. 8. In more detail, the arrestor arm 64 which projects downwardly and outwardly at an angle to a vertical passing through the pulley member 16 may be made as a U-shaped or yoke member 71 having arms 72 which straddle the housing 36, the arms 72 being connected by a cross piece which is defined hereinbefore as the portion 66 spaced outwardly and extending transversely of the pulley sheave 44. The U-shaped or yoke member 71 is fixedly secured to the housing member 36 by means of a pin 46 which extends therethrough and the free ends of the arms 72 are provided with in-turned flanges 74 which abut against the edges of the legs 38 and 40 of the housing member 36 so as to retain the arrestor arm 64 in a fixed operating position relative to the housing 36.

Figure 2:
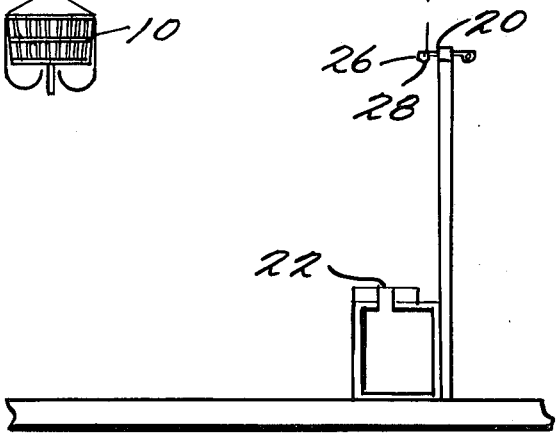
FIG. 2 is a fragmentary enlarged view of the improved safety pulley member illustrated in the circle of FIG. 1, the view showing the link chain with tension therein and the safety pulley member in its normal operating position.
Figure 3:
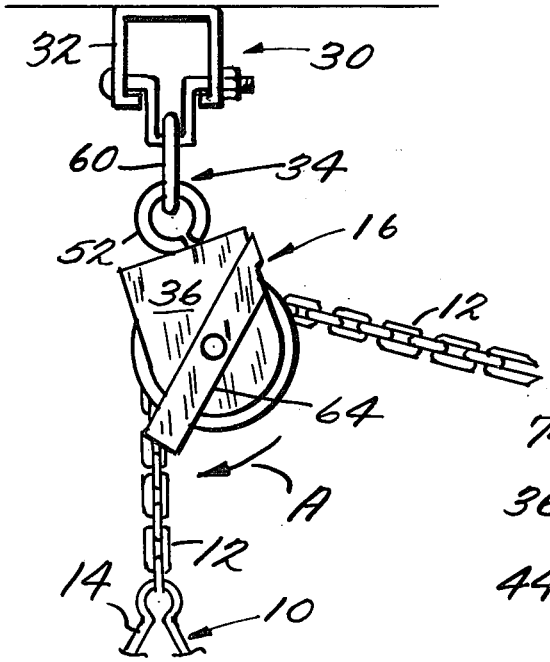
FIG. 3 is a view similar to FIG. 2 but enlarged thereover and illustrating the safety pulley member having swivelled or swung to a position arresting the link chain when tension is removed from the chain.
Figure 7:
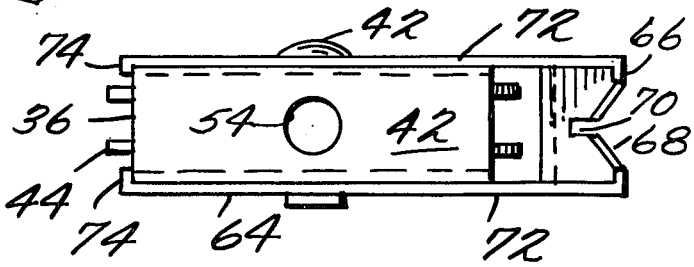
FIG. 7 is a top elevational view of the pulley member of FIG. 4 but with the swivel means omitted for purpose of clarity.

The operation of the system or apparatus just described may be best understood by reference to FIGS. 1, 2 and 3. As shown in FIG. 1 the weighted article 10 is disclosed suspended in its lowered position where a person can place or remove clothing, shoes or the like from the article or receptacle 10. In this position the link chain 12 is fulley extended between the weighted article 10 and the attachment means 20 and, thus, it is placing a load on both the safety pulley member 16 and the second pulley member 18 and since each of these pulley members is supported from the overhead support means 30 by swivel means 34, they will swivel at an angle to a vertical through their points of attachment. Referring to FIG. 2 it will be noted that when the safety pulley member 16 has swivelled to an equilibrium position away from the vertical through its point of attachment, the arrestor arm 64 is out of the path of travel of the link chain 12. Also, because of the double swivel action of the swivel means 34 the pulley members 16 and 18 respectively align for the most convenient path of travel for the link chain 12.

With the system or apparatus in normal operation, such as during raising and lowering of the weighted article 10 or when the weighted article 10 is suspended in either its lowered position or elevated position, the tension is maintained in the link chain 12 and both pulley members stay in their angled position and there is no interference from the arrestor arm 64 during such operation. However, if an emergency situation is encountered, such as when an operator inadvertently lets go of the the link chain 12 during operation of raising and lowering of the weighted article 10 or if the link chain breaks between the safety pulley member 16 and the connection of the link chain 12 with the attachment means 20, the tension in the link chain 12 is immediately reduced and the weighted article 10 begins to freely drop by gravity. This condition reduces the load on the safety pulley member 16 and it swings by gravity toward the vertical through its point of attachment as shown by the arrow A and in FIG. 3 and this brings the arrestor arm with its portion 66 into the downward path of movement of the link chain 12. The V-shaped guide or slot directs a single link of the link chain 12 into the rectangular slot 70 of the portion 66 and immediately no further links can pass and the weighted article 10 is arrested in its fall.

Figures 10, 11:
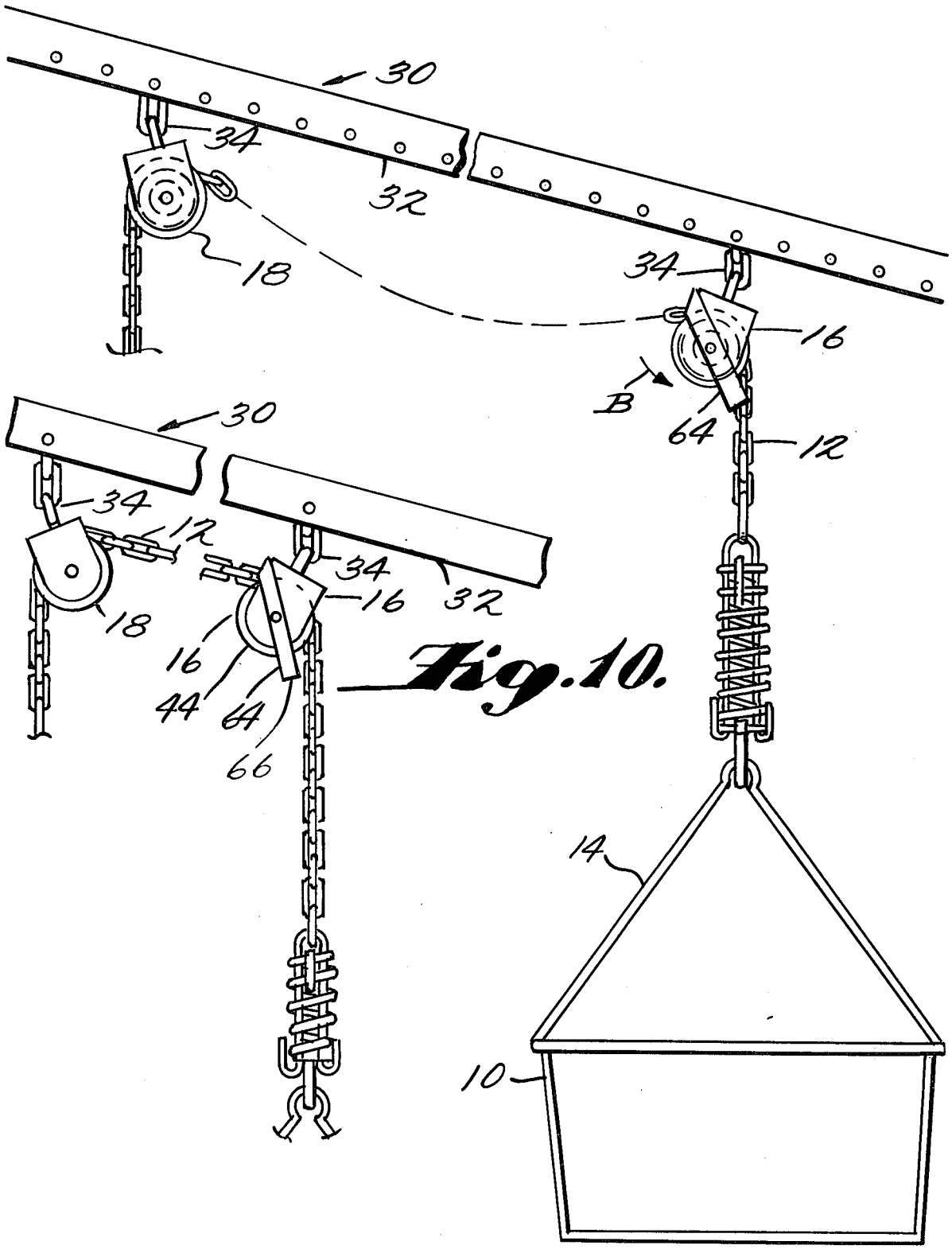
FIG. 10 is a fragmentary schematic view similar to FIG. 1 but illustrating the pair of pulley members of the system spaced apart horizontally and vertically with respect to each other and with the safety pulley member in its normal operating position.
FIG. 11 is a view similar to FIG. 10 but illustrating the safety pulley member swinging or swivelling to a position where it arrests the link chain when tension in the link chain has been relieved.
Figure 15:
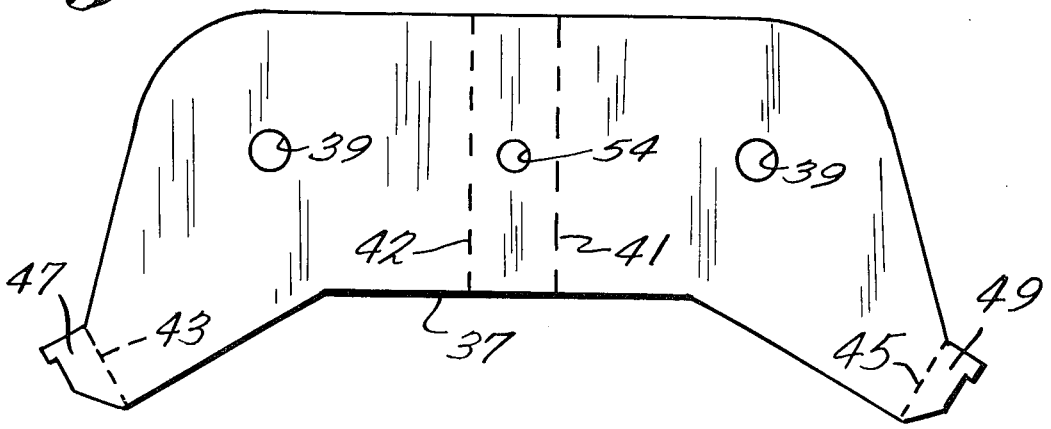
FIG. 15 illustrates a foldout housing pattern for the housing of the pulley member of FIG. 12.
Figure 12:
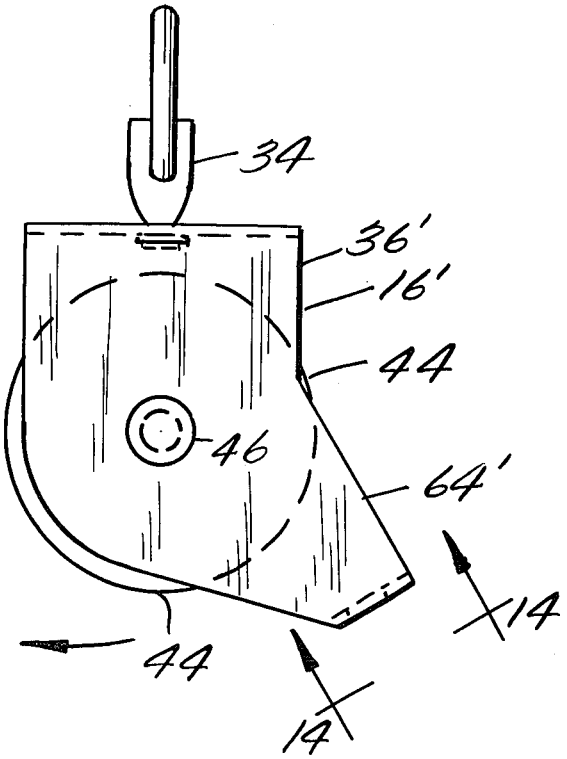
FIG. 12 is a side elevational view similar to FIG. 4 but illustrating a modified form of construction of the safety pulley member.
Figure 13:
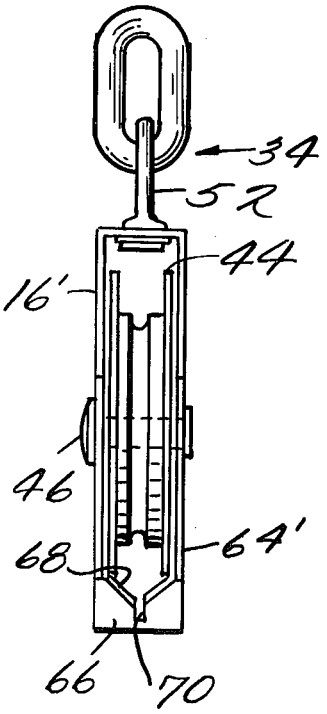
FIG. 13 is an end elevational view of the pulley member of FIG. 12 looking from the right to the left of FIG. 12.
Figure 14:
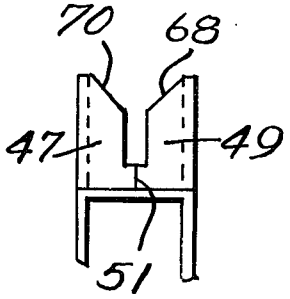
FIG. 14 is a view taken substantially on the line 14—14 of FIG. 12.

Referring now to FIGS. 10 and 11 it will be noted that the pulley members 16 and 18 are not only horizontally spaced but are also vertically spaced and this condition would exist where the overhead support means 30 is such to accommodate for a ceiling or roof extending on an angle to the horizontal. Where the angle of a line extending between the pulley members 16 and 18 is at an angle of 0° up to about 15° with the horizontal, the safety pulley member 16 may be placed either at the high position or the low position and the operation of the system or apparatus will be satisfactory. However, as this angle increases from fifteen degrees and above, it has been discovered for best operation that the satety pulley member 16 must be positioned lower than the pulley member 18 as shown in FIGS. 10 and 11. FIG. 10 illustrates a normal condition of operation wherein there is tension in the link chain 12 and the pulley members 16 and 18 are loaded to be swivelled at an angle to a vertical through their points of attachment with the safety pulley member 16 having its arrestor arm 64 and its portion 66 with the stop means thereon out of the path of travel of the link chain 12 from the weighted article 10 over the pulley sheave 44. FIG. 11 depicts an emergency condition wherein the tension in the link chain 12 has been reduced because of failure of the chain between the pulley member 16 and its point of connection to the attachment means 20 or because of inadvertent release by an operator and since the tension in the link chain 12 has been reduced, the load is removed from the pulley member 16 and it has swung or swivelled in the direction B so that its arrestor arm has moved into the path of the link chain and engages in single link, as previously described, to arrest further drop by gravity of the weighted article 10.

Referring now to FIGS. 12–15 inclusive there is disclosed a modified safety pulley member 16' which has a housing 36' and arrestor arm 64' made as a unit from a single piece of galvanized steel. In more detail a pattern is used to cut a piece 37 from a flat sheet of material and apertures 39 are stamped in the piece as well as the aperture 54 for receiving the swivel connector 52. The piece 37 is folded along the lines 41 and 42 to provide the U-shaped housing 36' and the arms of the arrestor arm 64. Then further folds are made at 43 and 45 to provide flaps 47 and 49 which form the cross piece 66 with the V-shaped guide 68 and rectangular slot 70. Of course, the flaps 47 and 49 are welded together as indicated at 51 so that the housing 16' and the arrestor arm 64' provide a rigid structure. The pulleys sheave 44 is positioned within the housing 16' and is rotatably supported by the pin 56 extending through the holes 39.

While the pulley member 16' can be fabricated from a single piece 37 of sheet material to form a unitary housing and arrestor arm, it has been found that from a fabrication standpoint, it is less expensive and easier to fabricate the safety pulley member shown in FIGS. 4–9 inclusive. However, the pulley member 16' will function identically with that of the pulley member 16 when incorporated into the safety system or apparatus of the present invention.

The terminology used throughout this specification is for the purpose of description and not limitation as the scope of the invention is defined by the claims. It will be apparent to those skilled in the art that the embodiments discussed herein may be changed to provide fully equivalent structures and function.

What is claimed is:

1. In a system for raising and lowering a weighted article between supported elevated and supported lower positions, the combination comprising:

an overhead support means;

a pair of pulley members supported from said support means at laterally spaced points from each other;

means to swivel support one of said pulley members from said overhead support means;

a fixed attachment means supported within reach of a person;

a link chain connected at one end to the article and passing vertically upwardly over the swivel supported pulley member and then the other pulley member and extending downwardly and connected at its other end to said attachment means said chain having a length when fully extended sufficient to permit said article to be suspended within reach of a person;

means on said chain positioned a sufficient distance from the end of the chain connected to said attachment means for connecting the chain to said attachment means when the chain is drawn downwardly to raise the article to the elevated position;

said means to swivel support one of the said pulley members permitting said one of said pulley members to swivel at an angle to a vertical through its point of support to said support means during normal operation of raising, lowering and supporting the article in elevated and lower positions;

The improvement comprising said swivel supported pulley member including a housing, a pulley sheave rotatably supported in said housing, a chain arrestor arm projecting from said housing and fixed relative to said housing and having at least a portion extending transverse of and spaced from the pulley sheave and out of the path of said chain during normal operation, said arrestor arm having stop means on said portion for engaging and stopping said chain when tension in said chain between said swivel supported pulley member and said fixed attachment means is abruptly reduced and said swivel supported pulley member swings toward the vertical and moves the arm fixed thereto and stop means into engagement with the chain.

2. A system as claimed in claim 3 in which said stop means on said portion of said arrestor arm includes a V-shaped guide terminating in a rectangular slot, said V-shaped guide directing one link of the chain into the rectangular slot which resists passage of further links.

3. In a system for raising and lowering a weighted article between supported elevated and supported lower positions, the combination comprising:

an overhead support means;

a pair of pulley members supported from said support means at laterally spaced points from each other;

means to swivel support one of said pulley members from said overhead support means;

a fixed attachment means supported within reach of a person;

a link chain connected at one end to the article and passing vertically upwardly over the swivel supported pulley member and then the other pulley member and extending downwardly and connected at its other end to said attachment means, said chain having a length when fully extended sufficient to permit said article to be suspended within reach of a person;

means on said chain positioned a sufficient distance from the end of the chain connected to said attachment means for connecting the chain to said attachment means when the chain is drawn downwardly to raise the article to the elevated position;

said means to swivel support one of the said pulley members permitting said one of said pulley members to swivel at an angle to a vertical through its point of support to said support means during normal operation of raising, lowering and supporting the article in elevated and lower positions;

the improvement comprising said swivel supported pulley member including a housing, a pulley sheave rotatably supported in said housing, said pulley sheave being rotatably supported by a pin extending through said housing, a chain arrestor arm projecting from said housing and fixed relative to said housing and having at least a portion extending transverse of and spaced from the pulley sheave and out of the path of said chain during normal operation, said arrestor arm having stop means on said portion for engaging and stopping said chain when tension in said chain between said swivel supported pulley member and said fixed attachment means is abruptly reduced and said swivel supported pulley member swings toward the vertical and moves the arm fixed thereto and stop means into engagement with the chain, said arrestor arm being a U-shaped member also supported on said pin, said U-shaped member having means thereon for abutting said housing to retain said arrestor arm in a fixed operation position.

4. A system as claimed in claim 3 in which said U-shaped member includes a pair of arms connected by a cross piece spaced radially outwardly of said pulley sheave, said stop means including a V-shaped guide terminating in a rectangular slot and positioned in said cross piece, said V-shaped guide directing one link of the chain into said slot to resist passage of other links when tension is relieved from said chain.

5. A system as claimed in claim 1 in which said arrestor arm is fixed relative to said housing by being integrally formed on said housing.

6. A system as claimed in claim 5 in which said housing is a U-shaped member and in which said arrestor arm includes a pair of arm elements extending from said housing and connected by a cross piece spaced radially outwardly of said pulley sheave, said stop means including a V-shaped guide terminating in a rectangular slot and positioned in said cross piece, said V-shaped guide directing one link of the chain into said slot to resist passage of other links when tension is relieved from said chain.

7. A system as claimed in claim 3 in which said arrestor arm projects downwardly and outwardly from said housing at an angle to the vertical through the point of support of said swivel supported pulley member.

8. A system as claimed in claim 3 in which said pair of pulley members are supported at spaced points horizontally from each other.

9. A system as claimed in claim 8 in which said pulley members are supported at different vertical elevations.

10. A system as claimed in claim 9 in which said swivel supported pulley member is supported at a lower elevation than the other pulley member.

11. A system as claimed in claim 10 in which an angle between the horizontal and a line through said pair of pulley members is in the order of 15° or greater.

12. A system as claimed in claim 3 including means to swivel support the other of said pulley members from said overhead support means.

13. A safety pulley for attachment to an overhead support means and used in systems to raise and lower and suspend a weighted article by a link chain, said pulley member comprising:

a U-shaped housing including a pair of spaced legs connected together by a cross piece;

a pulley sheave;

a pin extending through said housing for rotatably supporting said pulley sheave;

swivel means carried by said cross piece for attachment to the overhead support means, said swivel means permitting said pulley member to swivel at an angle to a vertical when the link chain with tension therein passes over the pulley sheave; and a chain arrestor arm fixed relative to and projecting from said housing in a downwardly and outwardly direction and having a portion extending transverse of and spaced from the pulley sheave, said arrestor arm having stop means on said portion for engaging and stopping the link chain when tension in said chain is reduced to permit the pulley member to swivel toward a vertical position, said arrestor arm being a U-shaped member also supported on said pin, said U-shaped member including a pair of arm elements connected by a cross piece spaced radially outwardly of said pulley sheave, said cross piece containing a V-shaped guide terminating in a rectangular slot to provide said stop means, said V-shaped guide being capable of directing a link of the chain into the rectangular slot and thus resist passage of further links, and means on the free end of at least one of said arms for abutting said housing to retain said arrestor arm fixed relative to said housing when in an operating position.

14. A safety pulley member as claimed in claim 13 in which said means on at least one of said arm elements includes an inwardly turned flange.

* * * * *